US009107458B1

(12) United States Patent
Beathard

(10) Patent No.: US 9,107,458 B1
(45) Date of Patent: Aug. 18, 2015

(54) TIE CLIP SYSTEM

(71) Applicant: Brian P. Beathard, Franklin, TN (US)

(72) Inventor: Brian P. Beathard, Franklin, TN (US)

( * ) Notice: Subject to any disclaimer, the term of this patent is extended or adjusted under 35 U.S.C. 154(b) by 267 days.

(21) Appl. No.: 13/784,972

(22) Filed: Mar. 5, 2013

(51) Int. Cl.
*A41D 25/00* (2006.01)

(52) U.S. Cl.
CPC ..... *A41D 25/00* (2013.01)

(58) Field of Classification Search
CPC ..... A44B 6/00; A41D 25/003
USPC ..... 2/144, 145, 156; 24/66.5
See application file for complete search history.

(56) References Cited

U.S. PATENT DOCUMENTS

| | | | | |
|---|---|---|---|---|
| 1,291,090 | A | 1/1919 | Nuzum | |
| 1,751,963 | A * | 3/1930 | Weinschreider | 2/145 |
| 2,581,274 | A | 1/1952 | Mix | |
| 2,608,729 | A | 9/1952 | Meeker | |
| 2,671,900 | A * | 3/1954 | Schreter | 2/145 |
| 2,723,429 | A | 11/1955 | Boots | |
| 2,946,106 | A | 7/1960 | Moran, Jr. | |
| 5,095,546 | A | 3/1992 | Jones | |
| 5,315,713 | A | 5/1994 | Pileggi | |
| 6,131,200 | A | 10/2000 | McNamara | |
| 8,127,371 | B2 | 3/2012 | Kelley | |
| 2008/0072362 | A1 | 3/2008 | Shearon | |

FOREIGN PATENT DOCUMENTS

| | | |
|---|---|---|
| JP | 5059604 | 3/1993 |

OTHER PUBLICATIONS

Website thread entitled http://www.thefedoralounge.com/showthread.php?64586-Grayco-End-lock-Tie-1930s-Expensive-but-Functional (last accessed Mar. 22, 2013).

* cited by examiner

*Primary Examiner* — Jack W Lavinder
(74) *Attorney, Agent, or Firm* — Shane V. Cortesi

(57) ABSTRACT

The present invention relates to a system for clipping a necktie to a dress shirt. The system includes a necktie and a clip that attaches to a loop on the rear portion of the necktie. The clip has a front prong that passes through an aperture in the necktie loop and a rear prong that is placed behind a panel of the dress shirt. The tie clip allows the necktie to lie vertically (not crooked) along the dress shirt and is hidden from view when in use.

19 Claims, 5 Drawing Sheets

TIE CLIP SYSTEM

BACKGROUND

1. Technical Field

The present invention relates to a system for clipping a men's necktie to a dress shirt.

2. Background of the Invention

Although many U.S. companies have gone to a business casual dress code, suits and neckties are still worn by men in many industries. For those wearing neckties and suits, maintaining a professional appearance remains critically important. Thus, a disheveled look caused by, for example, wind blowing the necktie and causing it to lie crooked on the shirt is not desirable. In addition, neckties are prone to getting wet when wearers lean over a sink to wash their hands.

Various systems have been developed to secure neckties to dress shirts. For example, U.S. Pat. Nos. 2,723,429, 2,608,729, and 2,581,274 each describe a tie clip that secures a necktie to a dress shirt. However, the clips described in the aforementioned patents are visible when worn, which is disadvantageous because tie clips can go into and out of style quickly.

U.S. Pat. No. 2,019,782 ("the '782 patent") teaches a tie clip that attaches to the rear of the thick portion of the tie. The commercial embodiment of the '782 patent is the Grayco END-LOCK clip. The END-LOCK clip, however, is relatively small in size and is prone to allowing the tie to lie crooked on the dress shirt, as it is not attached at the center of the width of the tie.

Thus, there is a need for tie clip systems that secure a necktie to dress shirts and allow the necktie to lie in a generally vertical manner along the shirt's length. It is especially desirable to develop tie clips that are hidden from view when worn.

BRIEF SUMMARY

The present disclosure provides a tie clip system for attaching a necktie to a dress shirt. In some embodiments, the tie clip system includes a necktie, a tie clip and a dress shirt. The necktie has a front, a rear configured to face the dress shirt, a proximal end, a distal end, a tie length extending from the proximal end to the distal end, a variable tie width perpendicular to the tie length, a thick portion in which the necktie has a first width, a thin portion in which the necktie has a second width, the second width shorter than the first width, and at least one loop. The at least one loop has a first end attached to the rear of the thick portion, a second end also attached to the rear of the thick portion, a middle portion between the first and second ends and unattached to the rear of the thick portion, a front facing the rear of the thick portion, a rear configured to face the dress shirt, and a tie loop aperture located in the tie loop. The at least one loop is configured to allow the thin portion of the tie to pass between the front of the at least one tie loop and the rear of the thick portion and thereby secure the thin portion of the necktie to the thick portion of the necktie. The tie clip is removably attached to the tie loop and includes a front prong having a segment received in the tie loop aperture and another segment located between the tie loop front and the rear of the thick portion of the necktie, and a rear prong pivotally attached to the front prong. The dress shirt has a left panel and a right panel, each of which has a front and a rear, and the rear prong of the tie clip is placed behind one of the left and right panels (typically the left panel), preferably between adjacent buttonholes on the shirt, so that the tie clip secures the necktie to the dress shirt.

Preferably, the tie clip is hidden from view when in use, from the perspective of a person standing in front of the person wearing the dress shirt. Preferably, the tie loop aperture is offset from the lengthwise center of the tie loop. Preferably, the neck tie has at least two loops and each loop has a first end attached to the rear of the thick portion and a second end also attached to the rear of the thick portion, a middle portion between the first and second ends and unattached to the thick portion, a front facing the rear of the thick portion and a rear configured to face the dress shirt. Preferably, when clipped to the shirt, the necktie extends generally vertically (i.e., not crooked) along the length of the dress shirt.

DETAILED DESCRIPTION

Figure 1A:
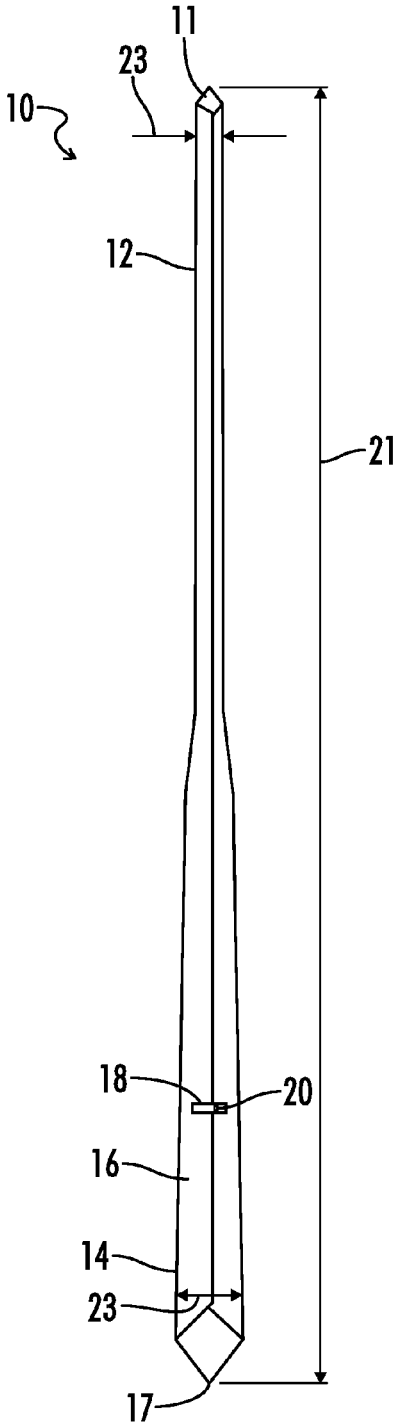
FIG. 1A illustrates a rear, elevation view of a men's necktie of one embodiment of the present invention; the necktie has one rear loop.

With reference to FIGS. 1-5, the present disclosure provides a system for attaching a men's necktie 10 to a men's dress shirt 42 using a tie clip 22. In the drawings, not all reference numbers are included in each drawing for the sake of clarity.

Figure 3:
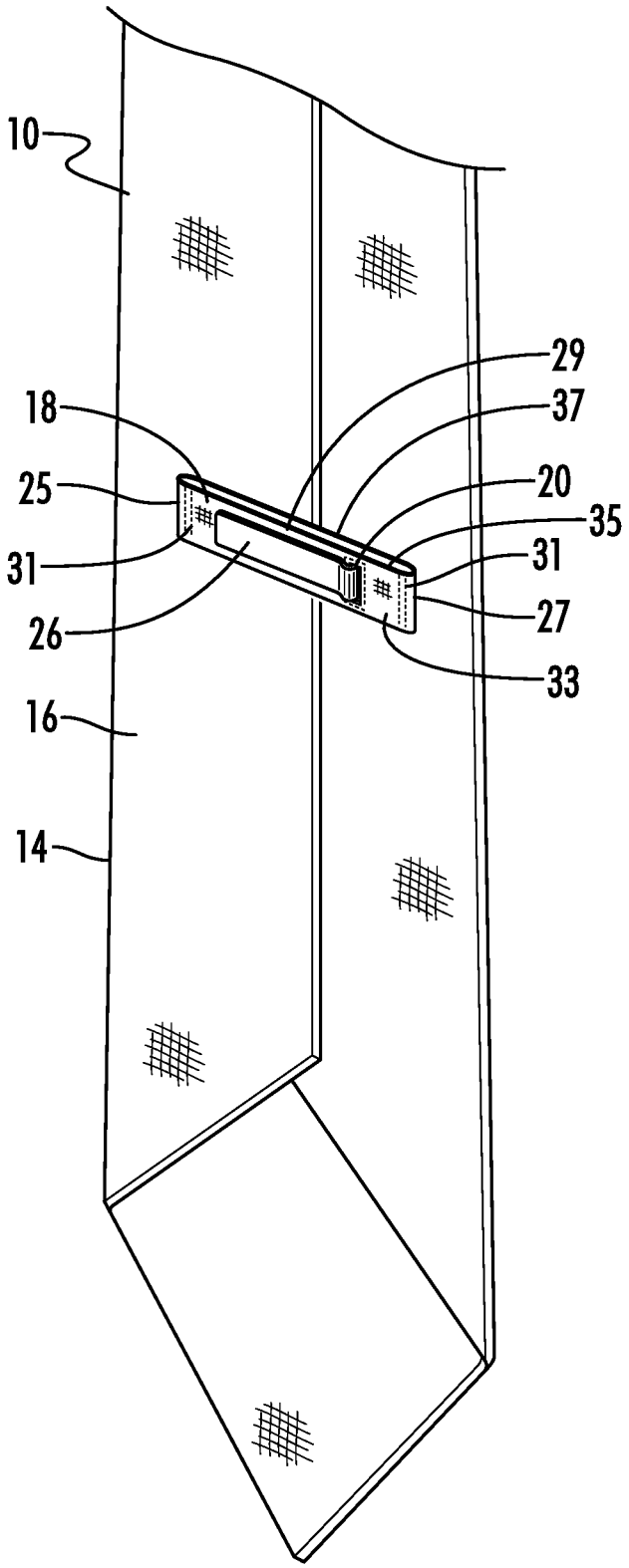
FIG. 3 illustrates a rear, perspective view of a tie clip removably attached to a loop of a men's necktie.
Figure 5:
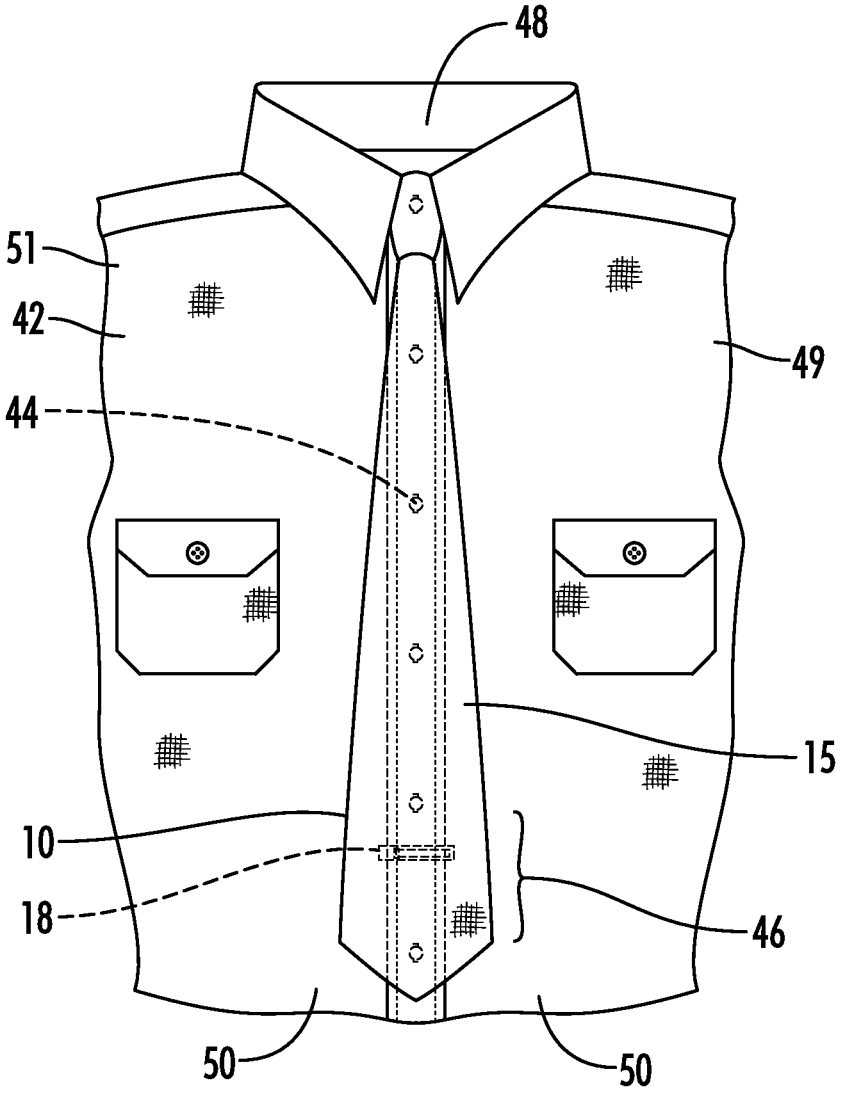
FIG. 5 illustrates a front view of the tie clip system in use; the necktie is lying straight on the men's dress shirt and is hidden from view.

Referring further to FIGS. 1, 3 and 5, the necktie 10 has a front 15, a rear 16 configured to face the dress shirt 42, a proximal end 11, a distal end 17, a tie length 21 extending from the proximal end 11 to the distal end 17, a variable tie width 23 perpendicular to the tie length 21, a thick portion 14 in which the necktie 10 has a first width, a thin portion 12 in which the necktie has a second width, wherein the second width is shorter than the first width, and at least one tie loop 18. The tie loop 18 has a first end 25 attached to the rear 16 of the thick portion 14, a second end 27 also attached to the rear 16 of the thick portion 14, a middle portion 29 between the first and second ends 25 and 27 and unattached to the rear 16 of the thick portion 14, a front 35 facing the rear 16 of the thick portion 14, a rear 33 configured to face the dress shirt 42, and a tie loop aperture 20. Optionally, the first end 25 and second end 27 are attached to the rear 16 of the thick portion 14 by stitching 31. Optionally, the first and second end 25 and 27 are attached to the rear 16 of the thick portion 14 by attachment to a second piece of material 37, which is attached directly to the rear 16 of the thick portion 14, as best seen in FIG. 3. The at least one tie loop 18 is configured to allow the thin portion 12 to pass between the loop 18 and the rear 16 of the thick portion 14 and thereby secure the thin portion 12 to the thick portion 14.

Figure 2A:
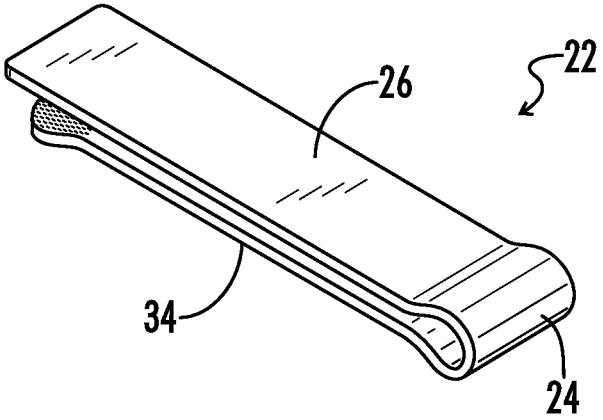
FIG. 2A illustrates a side, perspective view of one embodiment of a tie clip for use in the tie clip system of the present invention.
Figure 2B:
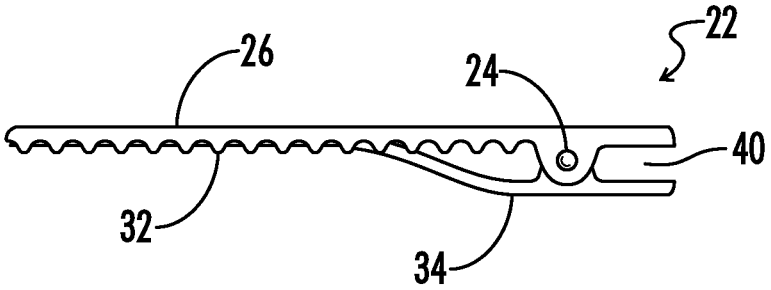
FIG. 2B illustrates a side, elevation view of one embodiment of a tie clip for use in the tie clip system of the present invention.

The tie clip system further includes a tie clip 22. As shown in FIGS. 2A and 2B, the tie clip 22 has a front prong 34 and a rear prong 26 pivotally attached to the rear prong 26. Two exemplary clips 22 are shown in FIGS. 2A and 2B. For example, the clip in FIG. 2A resembles a money clip and has a front prong 34, a rear prong 26 and a pivot point 24. Optionally, the clip 22 of FIG. 2A has a length extending from the pivot point 24 to the tip of the front prong 34 of from about 40 mm to about 50 mm and a width of from about 5 mm to about 15 mm. The clip in FIG. 2B has a front prong 34, a rear prong 26, a pivot pin 24, and a plurality of teeth 32 located in the rear prong 26 that are used to secure the tie clip 22 to the dress shirt 42. As shown in FIG. 2B, the front and rear prongs 26 and 34 may meet on one side of the pivot pin 24 (i.e., the left side in the view shown in FIG. 2B) and the front and rear prongs 26 and 34 may be parallel on the other side of the pivot pin 24 (i.e., the right side in the view shown in FIG. 2B) so that the prongs 26 and 34 are separated by a gap 40 of, e.g., about 5 mm. It will be appreciated that the clips shown in FIGS. 2A and 2B are only exemplary and other suitable clips may be used in the systems of the present invention.

Figure 4:
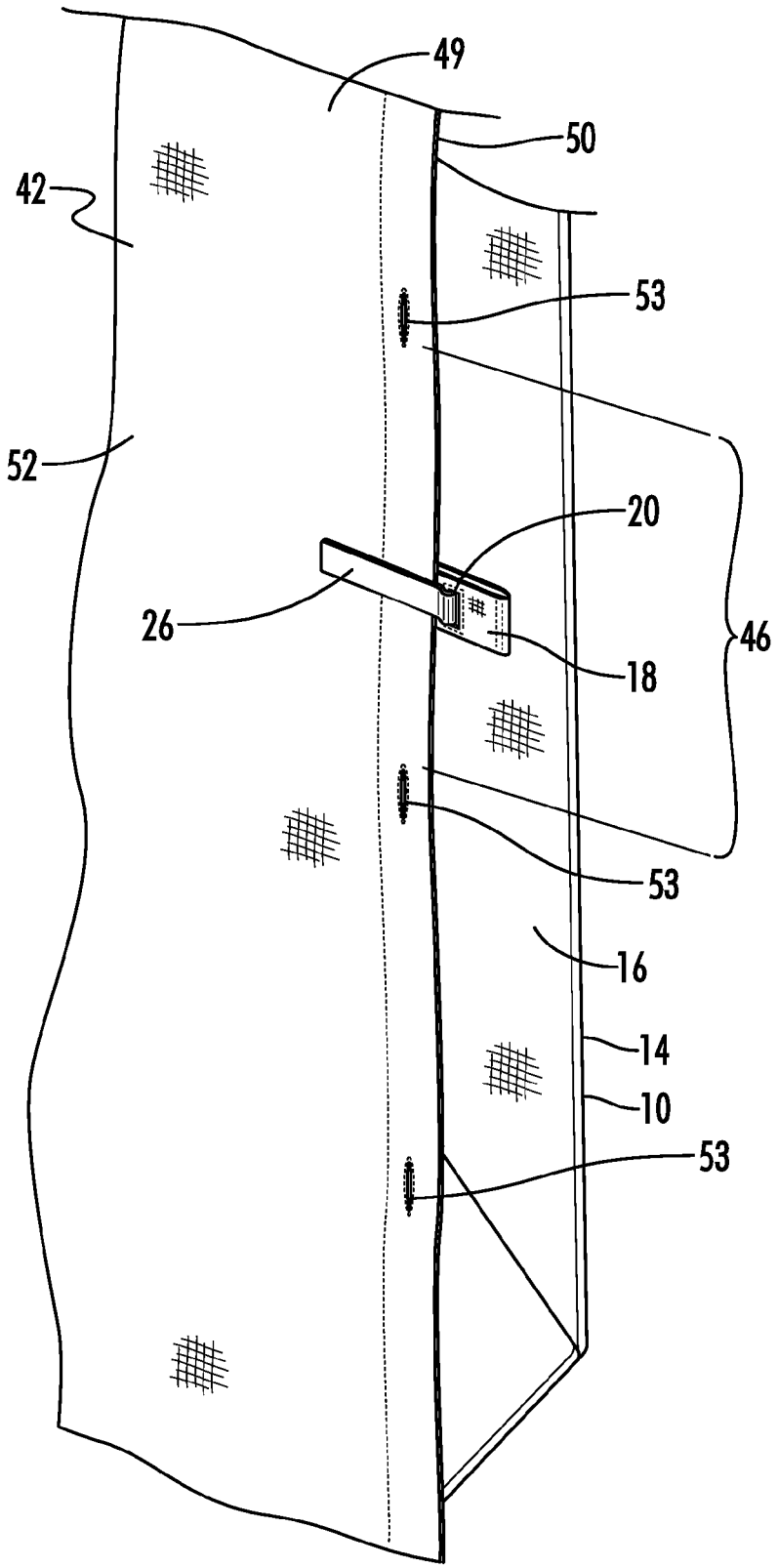
FIG. 4 illustrates a rear, perspective view of a tie clip attaching a men's necktie to a men's dress shirt.

The system further includes a dress shirt 42, as shown in FIGS. 4 and 5. The dress shirt 42 has a neck opening 48 and a left panel 49 and a right panel 51, each of which has a front 50 and a rear 52. Optionally, the dress shirt 42 includes a plurality of buttons 44 attached to the right panel 51 that are spaced along the length of the dress shirt 42 and a plurality of buttonholes 53 located in the left panel 49.

An exemplary method of operation of the system will now be described. It will be understood that the method of operation is only exemplary.

The necktie 10 and tie clip 22 are provided. The necktie 10 is tied in a knot (e.g., a Windsor knot) and the thin portion 12 of the necktie 10 is placed between the tie loop front 35 and the rear 16 of the thick portion 14 so that the thin portion 12 is secured to the thick portion 14.

A segment of the front prong 34 is positioned through the tie loop aperture 20 so that a segment of the front prong 34 is located in the tie loop aperture 20 and another segment of the front prong is located between the tie loop front 35 and the rear 16 of the thick portion 14, as shown in FIG. 3.

The dress shirt 42 is placed on a person. The rear prong 26 is positioned behind the left panel 49 in a gap 46 between adjacent buttonholes 53 (and in front of the right panel 51), thereby securing the necktie 10 to the dress shirt 42, as shown in FIG. 4. The dress shirt 42 is buttoned, as shown in FIG. 5.

Preferably, the tie clip 22 is hidden in view from a person standing about five feet directly in front of the person wearing the dress shirt 42 and the necktie 10 extends/hangs generally vertically along the length of the dress shirt 42.

Figure 1B:
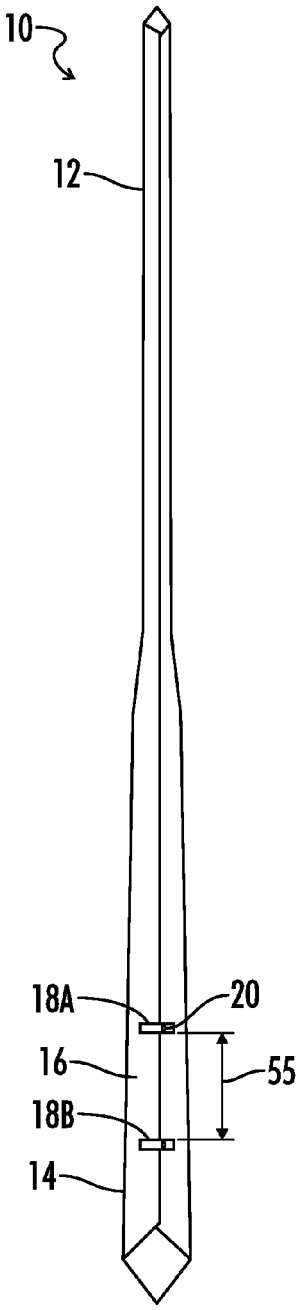
FIG. 1B illustrates a rear, elevation view of a men's necktie of one embodiment of the present invention; the necktie has two rear loops.
Figure 1C:
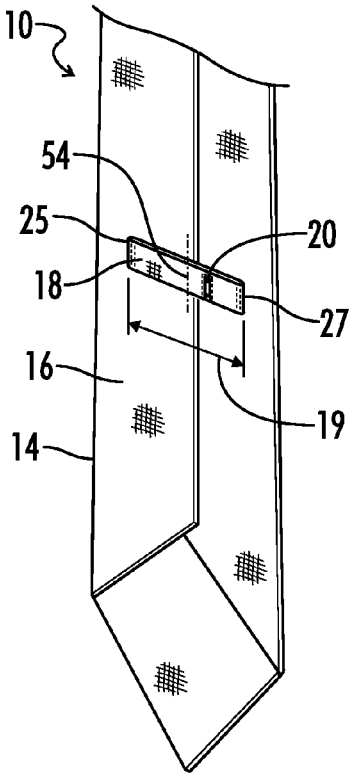
FIG. 1C illustrates a rear, perspective view of the thick portion of a men's necktie of one embodiment of the present invention; the necktie has one rear loop.

The tie loop 18 has a length 19 extending from the first end 25 to the second end 27 and a width perpendicular to the length 19. Preferably, the tie loop aperture 20 is offset from the lengthwise center 54 of the tie loop 18, as best seen in FIGS. 1C and 3. In some embodiments, the tie loop 18 has a length 19 of about 6 cm, a width of about 1.25 cm and the tie loop aperture 20 is offset from the lengthwise center 54 by about 1.5 cm. Optionally, the necktie 10 has two tie loops 18A and 18B, one above the other, as shown in FIG. 1B. The advantage of having two tie loops 18A and 18B is that attaching the tie clip 22 to the lower loop 18B may provide a different appearance than if the tie clip 22 is attached to the upper loop 18A. In addition, having two loops 18A and 18B decreases the chance the rear prong 26 will align with a buttonhole 53. Thus, preferably, if the necktie 10 has two loops 18A and 18B, the length of the gap 55 between the two loops 18A and 18B is different than the length of the gap 46 between adjacent buttonholes 53 found in a conventional dress shirt 42. As known to those of ordinary skill, the length of the gap 46 between adjacent buttonholes 53 found in a conventional dress shirt 42 is about 3 to about 3.5 inches.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims. In addition, the steps of any method described herein may be performed in any suitable order and steps may be performed simultaneously if needed.

What is claimed is:

1. A tie clip system for attaching a necktie to a dress shirt, the tie clip system comprising:

a necktie, the necktie having
- a front,
- a rear configured to face a dress shirt,
- a proximal end,
- a distal end,
- a tie length extending from the proximal end to the distal end,
- a variable tie width perpendicular to the tie length,
- a thick portion in which the necktie has a first width,
- a thin portion in which the necktie has a second width, the second width shorter than the first width, and
- a first loop, the first loop having
  - a first end attached to the rear of the thick portion,
  - a second end attached to the rear of the thick portion,
  - a middle portion between the first and second ends and unattached to the rear of the thick portion,
  - a front facing the rear of the thick portion,
  - a rear configured to face the dress shirt, and
  - a tie loop aperture located in the first loop between the first and second ends,
  - the first loop configured to allow the thin portion to pass between the front of the first loop and the rear of the thick portion and thereby secure the thin portion to the thick portion; and a tie clip removably attached to the first loop, the tie clip comprising a front arm, a rear arm, and a pivot located between the front arm and the rear arm, the rear arm pivotably attached to the front arm at the pivot, wherein the front arm is located between the front of the first loop and the rear of the thick portion of the necktie and the rear arm is located behind the rear of the first loop, wherein the front arm and rear arm sandwich the first loop, wherein the front arm comprises a length extending from the pivot to a tip of the front arm and a width perpendicular to the length, wherein the first loop comprises a length extending from the first end to the second end, wherein the tie loop aperture comprises a width perpendicular to the first loop length and further wherein the front arm width is less than the tie loop aperture width.

2. The tie clip system of claim 1, wherein the necktie has a second loop, the second loop having a first end attached to the rear of the thick portion and a second end attached to the rear of the thick portion, a middle portion between the first and second ends and unattached to the rear of the thick portion, a front facing the rear of the thick portion, and a rear configured to face the dress shirt.

3. The tie clip system of claim 1, wherein the tie loop aperture is offset from the lengthwise center of the first loop and is closer to the first end than the second end, and further wherein the front arm tip extends toward the second end.

4. The tie clip system of claim 1, wherein the system further comprises a dress shirt having left and right panels, the left and right panels each having a front and a rear, wherein the rear arm is positioned directly behind the rear of one of the left and right panels.

5. The tie clip system of claim 1, wherein the length of the front arm is between about 40 mm and about 50 mm.

6. The tie clip system of claim 1 wherein the necktie further comprises a knot.

7. The tie clip system of claim 1, wherein the rear arm of the tie clip comprises a plurality of teeth.

8. The tie clip system of claim 1 wherein the front and rear arms of the tie clip are configured to meet when the tie clip is not attached to the first loop.

9. The tie clip system of claim 1, wherein the pivot is adjacent to the tie loop aperture.

10. The tie clip system of claim 1, wherein the front arm and rear arm are generally flat as they extend across the first loop.

11. A method of clipping a necktie to a dress shirt, the method comprising the steps of:

a) providing a necktie, the necktie having
- a front,
- a rear configured to face a dress shirt,
- a proximal end,
- a distal end,
- a tie length extending from the proximal end to the distal end,
- a variable tie width perpendicular to the tie length,
- a thick portion in which the necktie has a first width,
- a thin portion in which the necktie has a second width, the second width shorter than the first width,
- a first loop, the first loop having
  - a first end attached to the rear of the thick portion,
  - a second end attached to the rear of the thick portion,
  - a middle portion between the first and second ends and unattached to the rear of the thick portion,
  - a front facing the rear of the thick portion,
  - a rear configured to face the dress shirt, and
  - a tie loop aperture located in the first loop between the first and second ends,
  - the first loop configured to allow the thin portion to pass between the front of the first loop and the rear of the thick portion and thereby secure the thin portion to the thick portion;

b) providing a tie clip comprising a front arm, a rear arm, and a pivot located between the front arm and the rear arm, the rear arm pivotally attached to the front arm; and c) placing the front arm through the tie loop aperture so that the front arm is located between the first loop front and the rear of the thick portion and the rear arm is located behind the rear of the first loop and so that the front arm and rear arm sandwich the first loop.

12. The method of claim 11 wherein the tie clip front arm and rear arm meet in step b).

13. The method of claim 11, wherein the method further comprises d) providing a dress shirt comprising left and right panels, the left and right panels each having a front and a rear; and e) placing the rear arm behind one of the left and right panels.

14. The method of claim 13, wherein the method further comprises placing a dress shirt on a person before step (e).

15. The method of claim 14, wherein after step (e), the necktie extends generally vertically along the dress shirt.

16. The method of claim 14, wherein after step (e), the tie clip is hidden in view from a person standing about five feet directly in front of the person wearing the dress shirt.

17. The method of claim 11 further comprising tying a knot in the necktie.

18. The method of claim 11 further comprising passing the thin portion between the front of the first loop and the rear of the thick portion.

19. The method of claim 11 wherein the pivot is adjacent to the tie loop aperture after step c).

* * * * *